US008402680B2

(12) United States Patent
Steinike et al.

(10) Patent No.: US 8,402,680 B2
(45) Date of Patent: Mar. 26, 2013

(54) SNOW THROWER IMPELLER

(75) Inventors: Daniel L. Steinike, West Bend, WI (US); James W. Mast, Sheboygan Falls, WI (US); Samuel J. Gerrits, Pewaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 258 days.

(21) Appl. No.: 12/916,399

(22) Filed: Oct. 29, 2010

(65) Prior Publication Data

US 2012/0102789 A1 May 3, 2012

(51) Int. Cl.
*E01H 5/09* (2006.01)

(52) U.S. Cl. ..... 37/251; 37/259

(58) Field of Classification Search ..... 37/222, 37/233, 248, 251, 252, 256, 259; 416/231 B, 416/234; 241/277, 278.1; 366/325.4, 328.3; D8/8; 172/13, 15; 30/347, 348, 351, 357; 56/295

See application file for complete search history.

(56) References Cited

U.S. PATENT DOCUMENTS

| | | | | | |
|---|---|---|---|---|---|
| 200,874 | A | * | 3/1878 | Robert | 416/234 |
| 210,982 | A | * | 12/1878 | Armit | 416/242 |
| 285,212 | A | * | 9/1883 | Bell et al. | 416/227 R |
| 472,081 | A | * | 4/1892 | Sterling | 416/242 |
| 665,356 | A | * | 1/1901 | Wood | 416/234 |
| 695,389 | A | * | 3/1902 | Hammond | 416/175 |
| 1,186,880 | A | | 6/1916 | Canda | |
| 1,781,960 | A | | 11/1930 | Schultz | |
| 1,822,827 | A | * | 9/1931 | Shappell | 37/248 |
| 1,837,636 | A | * | 12/1931 | Voss | 68/133 |
| 2,003,073 | A | * | 5/1935 | Faber | 416/231 R |
| 2,076,975 | A | | 4/1937 | Bach | |
| 2,162,902 | A | | 6/1939 | Adams | |
| 2,281,289 | A | * | 4/1942 | Hewitt | 37/248 |
| 2,352,127 | A | * | 6/1944 | Sheldon | 241/191 |
| 2,609,058 | A | | 9/1952 | Place | |
| 2,630,464 | A | | 3/1953 | Dunkelberger | |
| 2,908,337 | A | * | 10/1959 | Surprise et al. | 172/549 |
| 2,978,040 | A | * | 4/1961 | Wirkkala | 416/228 |
| 3,072,424 | A | | 1/1963 | Mayne et al. | |
| 3,721,025 | A | * | 3/1973 | Orr | 37/227 |
| 3,736,674 | A | * | 6/1973 | Enters | 37/248 |
| 3,805,421 | A | * | 4/1974 | Kamlukin et al. | 37/233 |
| 3,913,247 | A | * | 10/1975 | Ruhl | 37/258 |
| 3,951,611 | A | * | 4/1976 | Morrill | 428/587 |
| 4,360,983 | A | * | 11/1982 | Krug | 37/233 |
| 4,549,365 | A | * | 10/1985 | Johnson | 37/251 |
| 4,646,850 | A | | 3/1987 | Brown et al. | |
| 4,671,739 | A | * | 6/1987 | Read et al. | 416/230 |
| 4,783,915 | A | * | 11/1988 | Sasaki et al. | 37/251 |
| 4,964,502 | A | * | 10/1990 | Buschbom | 198/642 |
| 5,035,317 | A | * | 7/1991 | Buschbom | 198/642 |
| 5,112,192 | A | * | 5/1992 | Weetman | 416/201 A |
| 5,127,174 | A | | 7/1992 | Takeshita | |
| 6,101,794 | A | * | 8/2000 | Christopherson et al. | 56/6 |
| 6,470,662 | B1 | * | 10/2002 | Burke et al. | 56/255 |
| 6,769,236 | B2 | * | 8/2004 | Schaedler | 56/295 |
| 6,881,035 | B1 | | 4/2005 | Paulsen | |

(Continued)

FOREIGN PATENT DOCUMENTS

JP 2004027663 1/2004

*Primary Examiner* — Jamie L McGowan
(74) *Attorney, Agent, or Firm* — Rathe Lindenbaum LLP

(57) ABSTRACT

A snow thrower impeller includes a layer of material comprising a blade support wall and blades extending from the blade support wall.

26 Claims, 7 Drawing Sheets

U.S. PATENT DOCUMENTS 6,938,364 B2 * 9/2005 White et al. ..... 37/248
7,121,021 B2 * 10/2006 Sakai ..... 37/251
7,305,777 B2 * 12/2007 Kettering et al. ..... 37/233
7,617,664 B1 * 11/2009 Fitzpatrick ..... 56/295
2002/0178622 A1 12/2002 Loegering et al.
2008/0075598 A1 3/2008 Chen et al.

* cited by examiner

SNOW THROWER IMPELLER

BACKGROUND

Snow throwers, also known as snow blowers, utilize an impeller to throw snow. Existing snow thrower impellers may not efficiently throw the snow and may be expensive and difficult to manufacture.

DETAILED DESCRIPTION OF THE EXAMPLE EMBODIMENTS

Figure 1:
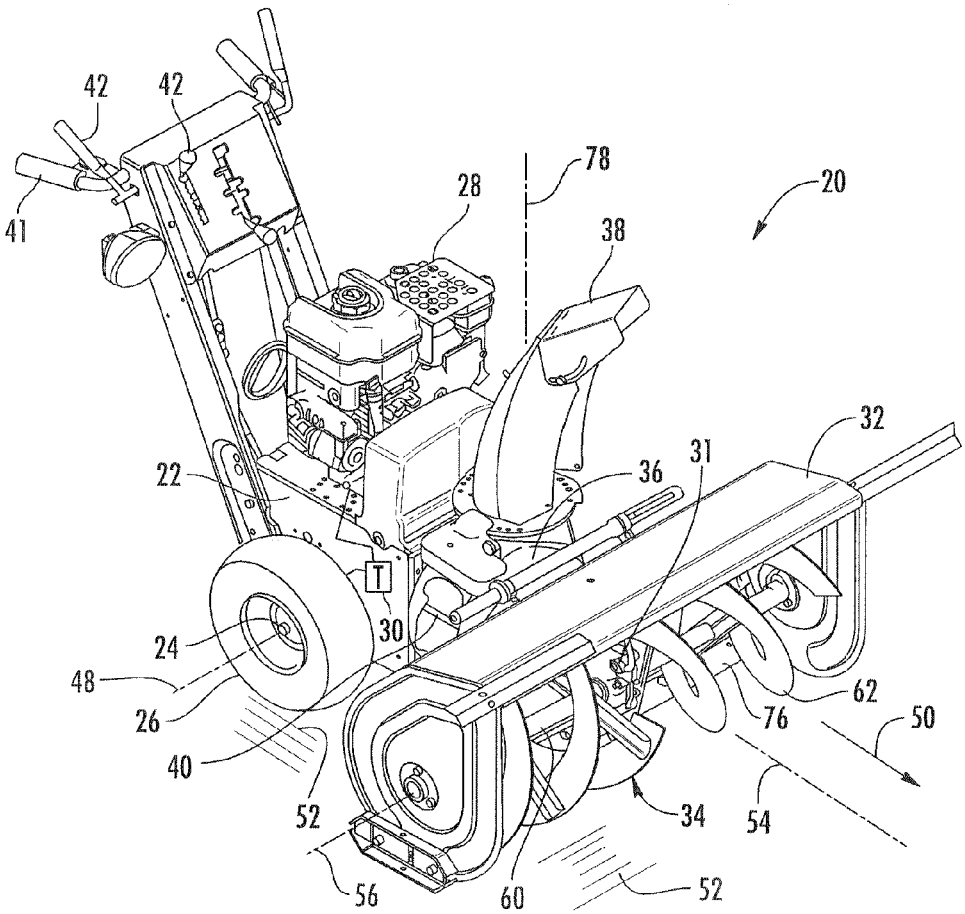
FIG. 1 is a perspective view of a snow thrower including an impeller assembly according to an example embodiment.

FIG. 1 is a front perspective view of a snow thrower 20 according to an example embodiment. As will be described hereafter, snow thrower includes an impeller assembly 40 having a simple and inexpensive impeller that efficiently throws snow. In addition to impeller assembly 40, snow thrower 20 includes frame 22, axle 24, wheels 26, engine 28, drive transmission 30 (schematically shown), discharge transmission 31, auger housing 32, auger 34, impeller housing 36 and discharge chute 38.

Frame 22 comprises one or more structures supporting the remaining components of snow thrower 20. In the example illustrated in which snow thrower 20 is a walk-behind snow thrower, frame 22 supports axle 24, wheels 26, engine 28, drive transmission 30, auger housing 32, auger 34, impeller housing 36, discharge chute 38 and impeller assembly 40. Frame 22 further supports handles or grips 41 and controls 42. In other embodiments where snow thrower 20 comprises a riding snow thrower, frame 22 may additionally support a seat and may be supported by a greater number of wheels, tracks or other ground propulsion members. In embodiments where snow thrower 20 is mounted to another vehicle, such as a lawnmower, an all terrain vehicle, truck or the like, frame 22 may or may not support axle 24 and wheels 26 and may be configured to be removably mounted to the vehicle. In embodiments where snow thrower 20 is powered by the engine or other torque source of the vehicle to which snow thrower 20 is mounted, frame 22 may not support an engine, such as engine 28, and may alternatively merely comprise a mounting structure or bracket supporting auger housing 32, auger 34, impeller housing 36, discharge chute 38 and impeller assembly 40 and facilitating their connection to the vehicle. Frame 22 may have a variety of different sizes and shapes, depending upon the machine or the method by which snow thrower 20 is moved across the terrain.

Figure 2:
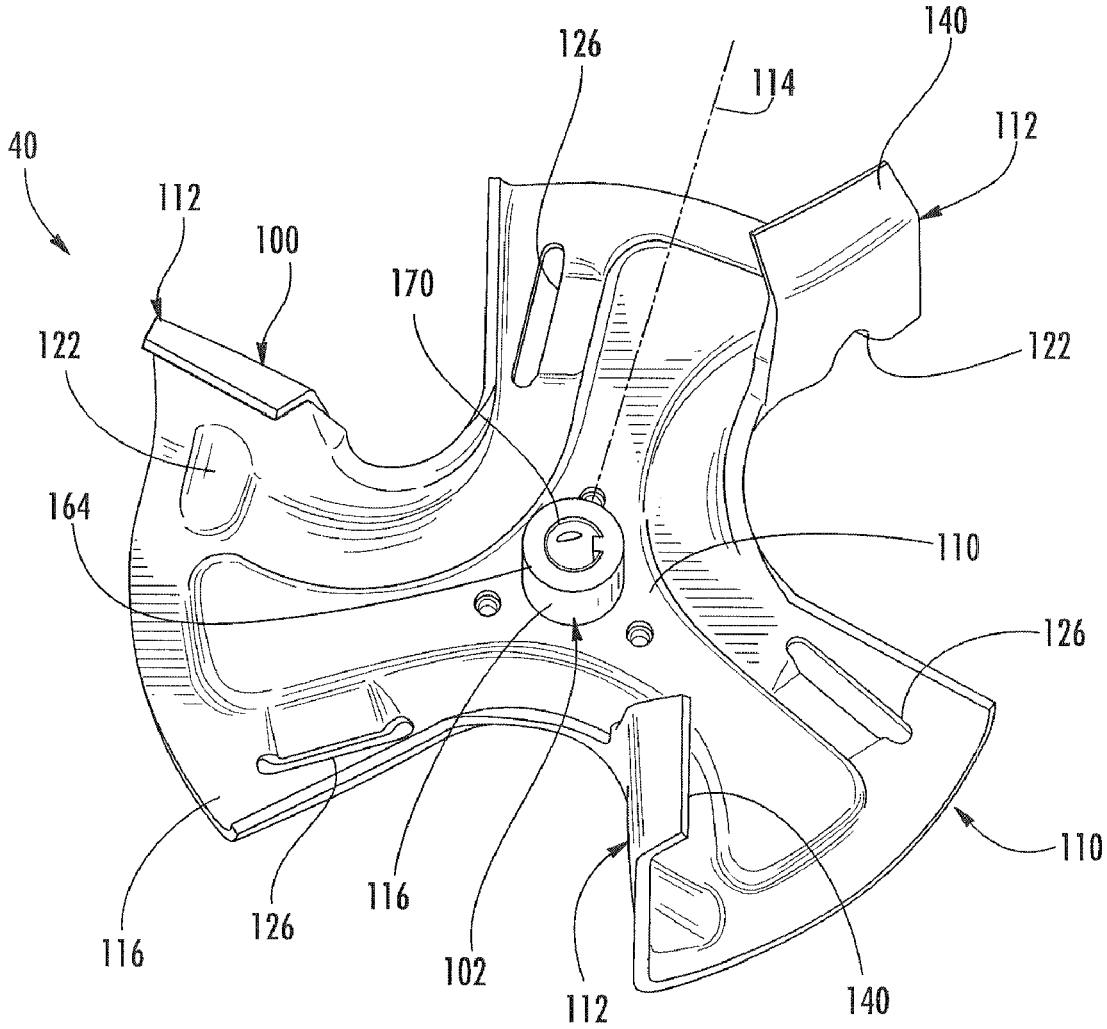
FIG. 2 is a top perspective view of the impeller assembly of FIG. 1.

Axle 24 is supported by frame 22 and rotationally supports wheels 26 (both of which are shown in FIG. 2). In the example illustrated, axle 24 is configured to be rotationally driven by engine 28 using torque transmitted by transmission 30. Axle 24 extends along an axis 48 that is substantially perpendicular to the direction of travel 50 of snow thrower 20.

Wheels 26 are joined to axle 24 so as to elevate and support frame 22 above the terrain 52. Wheels 26 further facilitate movement of snow thrower 20 across terrain 52. In the example illustrated, wheels 26 are rotationally driven to propel snow thrower 20. In other embodiments, wheels 26 may be physically pushed by a person or other vehicle. In some embodiments, wheels 26 may be replaced with one of more tracks or other ground engaging members. In embodiments where snow thrower 20 is supported along the terrain by another vehicle, axle 24 as well as wheels 26 may be omitted.

Engine 28 comprises an internal combustion engine supported by frame 22 and operably coupled to wheels 26 by drive transmission 30 so as to drive wheels 26. Engine 28 is further operably coupled to auger 34 and impeller assembly 40 by discharge transmission 31 so as to rotationally drive auger 34 about axis 56 and so as to rotationally drive impeller assembly 40 about axis 54. In other embodiments, engine 28 may alternatively only drive auger 34 and impeller assembly 40. In other embodiments, other mechanisms may be used to drive auger 34, impeller assembly 40 or drive wheels 26.

Transmission 30 (schematically shown) comprises a series or arrangement of structures configured to transmit torque from engine 28 to axle 24 or wheels 26. Likewise, discharge transmission 31 comprises a series or arrangement of structures configured to transmit torque from engine 28 to auger 34 and impeller assembly 40. Examples of such structures include, but are not limited to, drive shafts and driven shafts, chain and sprocket arrangements, belt and pulley arrangements, gear trains and combinations thereof. In one embodiment, transmission 31 is disposed on both sides of impeller 34, wherein transmission 36 extends between engine 28 and impeller assembly 40 and wherein transmission 36 further extends between impeller assembly 40 and auger 34. For example, in one embodiment, transmission 36 may include a bevel gear between impeller assembly 40 and auger 34 for converting torque about axis 54 from impeller assembly 40 to torque about axis 56 for auger 34.

Auger housing 32 forms the head of snow thrower 20 and partially extends about or partially surrounds auger 34. Auger housing 32 rotationally supports auger 34 for rotation about axis 56 which is perpendicular to axis 54 and the direction of forward travel 50. Auger housing 32 contacts and scrapes against terrain 52 so as to scrape and lift snow from terrain 52 and towards impeller assembly 40.

Auger 34 comprises a mechanism configured to slice or cut through snow and to direct or move such snow towards impeller assembly 40. Auger 34 includes a central shaft 60 supporting a helical ribbon or blade 62. Shaft 60 is rotationally supported about axis 54. Blade 62 cuts through the snow and directs snow towards axis 54 and towards an inlet opening to impeller 34. In other embodiments, auger 32 may have other configurations. For example, in lieu comprising ribbons, blade 62 may comprise full blades continuously extending from shaft 60.

Impeller housing 36 extends about impeller assembly 40 and opens into an interior of auger housing 32. Impeller housing 36 further opens into chute 38. Impeller housing 38 cooperates with impeller assembly 40 such that snow impelled or moved by impeller assembly 40 is directed up and through chute 38.

Chute 38 comprises one or more structures configured to receive snow impelled by impeller 34 and to direct such snow away from snow thrower 20. In the example illustrated, chute 38 is configured to be selectively rotated about a substantially vertical axis 78 such that snow may be blown or thrown to either transverse side of snow thrower 20 and at various rear and forward angles with respect to snow thrower 20. In one embodiment, chute 38 is configured to be manually rotated about axis 78. In other embodiments, such rotation may be powered. In yet other embodiments, chute 38 may be stationary.

Figure 3:
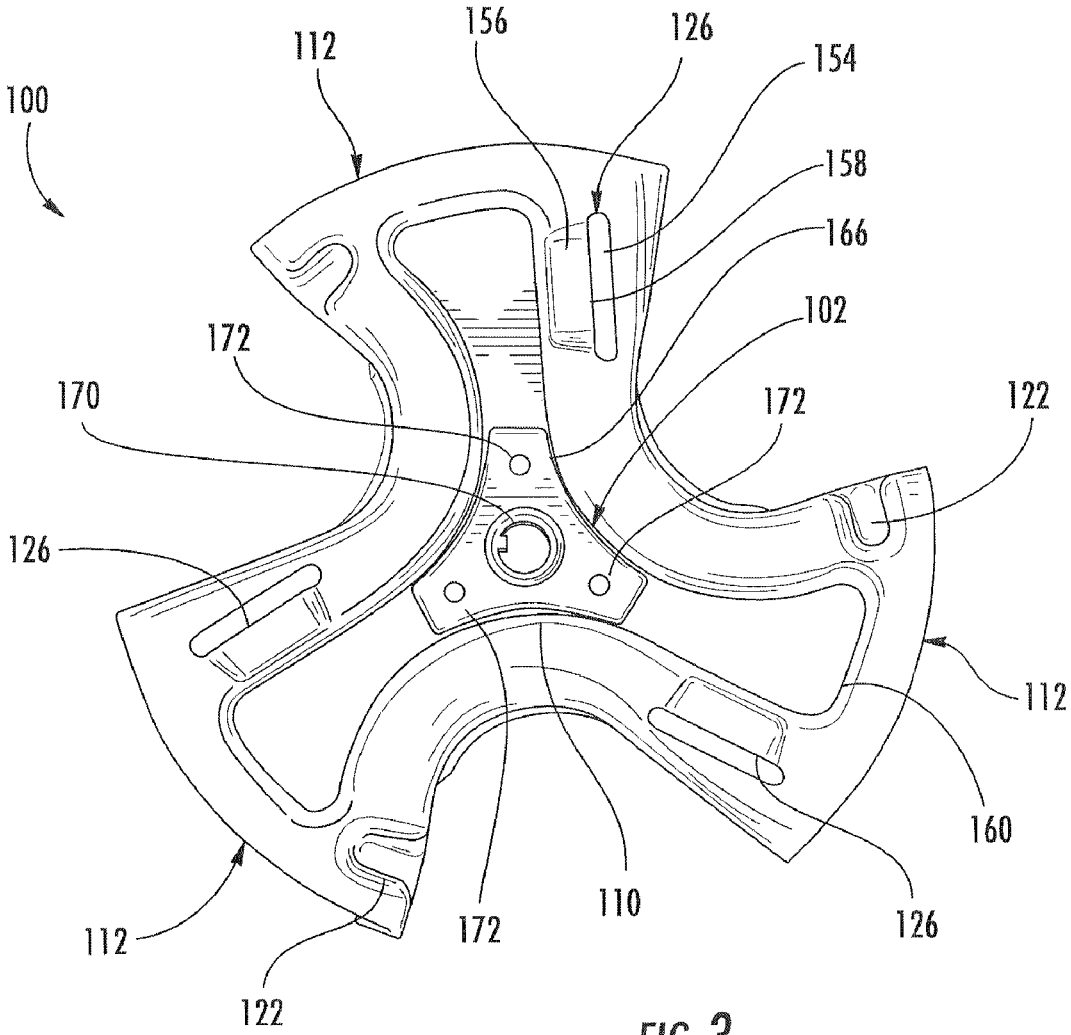
FIG. 3 is a rear perspective view of the impeller assembly of FIG. 2.

Impeller assembly 40 is configured to receive the snow gathered and directed to it by auger 34 and to further impel snow away from snow thrower 20 through chute 38. FIGS. 2 and 3 illustrate impeller assembly 40 in more detail. Impeller assembly 40 includes impeller 100 and shaft coupler 102.

Figure 4:
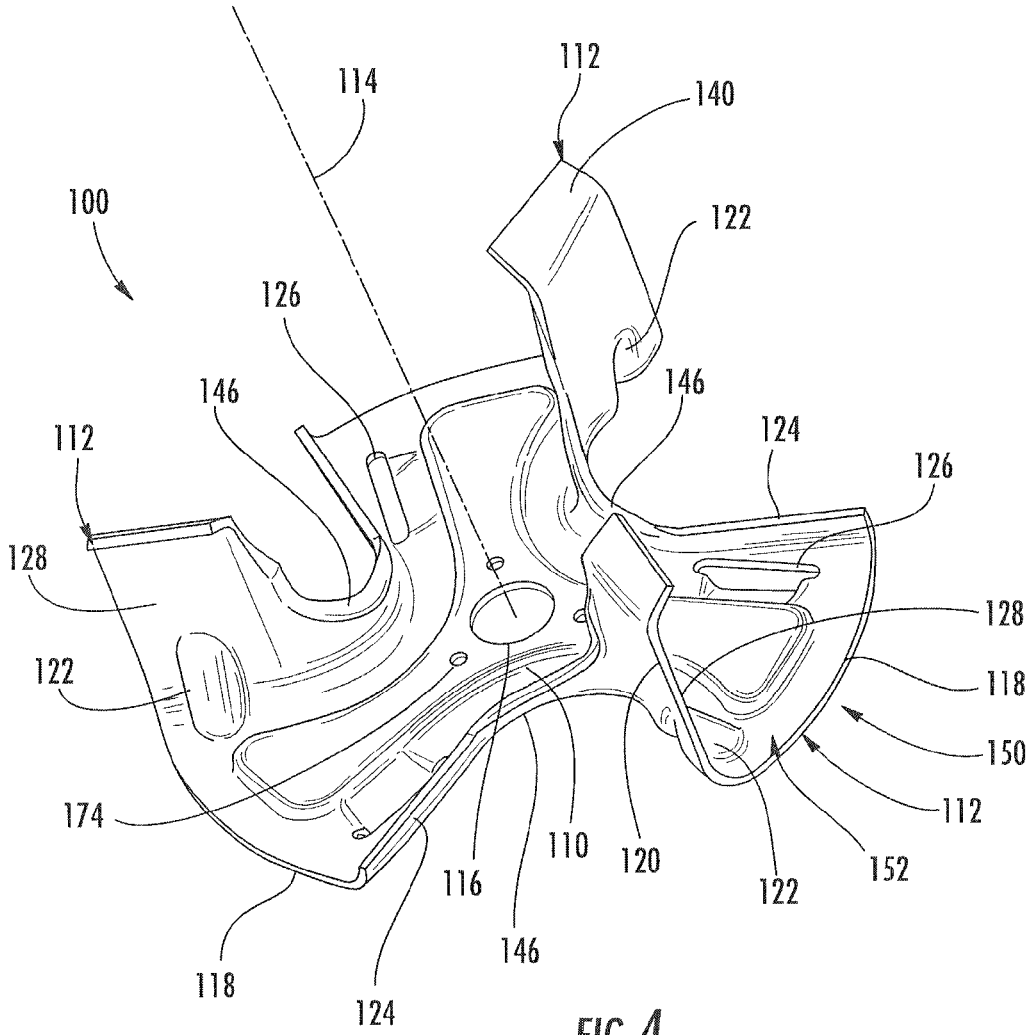
FIG. 4 is a top perspective view of an impeller of the impeller assembly of FIG. 2.

Impeller 100 is shown removed from shaft coupler 102 in FIGS. 4-9. As shown by FIG. 4, impeller 100 comprises a single layer of material shaped to form and provide a central portion 110 and a plurality of scoops or shovels 112 angularly spaced about central portion 110. In one embodiment, impeller 100 is formed from stamping a sheet of material, such as low carbon steel, wherein the three-dimensional structures of impeller 100 are formed by bending or deforming portions of the sheet. Because impeller 100 is formed by stamping a sheet of material and because its three-dimensional structures are formed by solely by deforming or bending portions of the sheet, the manufacture of impeller 100 may be done without welding or with minimal welding or molding and with a minimal number of fasteners, reducing manufacturing time, cost and complexity. In other embodiments, impeller 100 may be formed by other manufacturing processes. In one embodiment, the sheet of material may comprise a single homogenous layer of material. In other embodiments, the sheet of material may include multiple laminations of material to form a sheet which is subsequently shaped, such as being stamped and deformed.

Central portion 110 comprises that portion of impeller 100 that joins or interconnects each of shovels 112. Central portion 110 further facilitates connection of impeller 100 to shaft coupler 102 (shown in FIGS. 2 and 3). Central portion 110 extends generally perpendicular to a rotational axis 114 of impeller 100. Central portion 110 includes an aperture 116 configured to receive shaft coupler 102.

Shovels 112 comprise structures configured to scoop and throw snow through discharge chute 38. Each shovel 112 includes a back or blade supporting wall 118, blade 120, depression gusset 122, web 124 and louver 126. Blade support wall 118 serves as a back, bottom or floor of each shovel 112. Blade support wall 118 comprises a generally planar portion of impeller 100 extending from central portion 110 substantially perpendicular to the rotational axis 114 of impeller 100.

Blade 120 of each shovel 112 extends from an associated blade supporting wall 118. In the example, each blade 120 comprises an upstanding wall extending in a largely radial direction with respect to rotational axis 114. Each blade 120 extends from a trailing radial edge of each blade supporting wall 118. Each blade 120 has a snow driving face 128 facing in a direction in which impeller 100 is rotated by engine 28 (shown in FIG. 1). For purposes of this disclosure, the term "snow driving face" means those surfaces that contact and force or throw snow through a discharge chute when the impeller is being driven.

Figure 5:
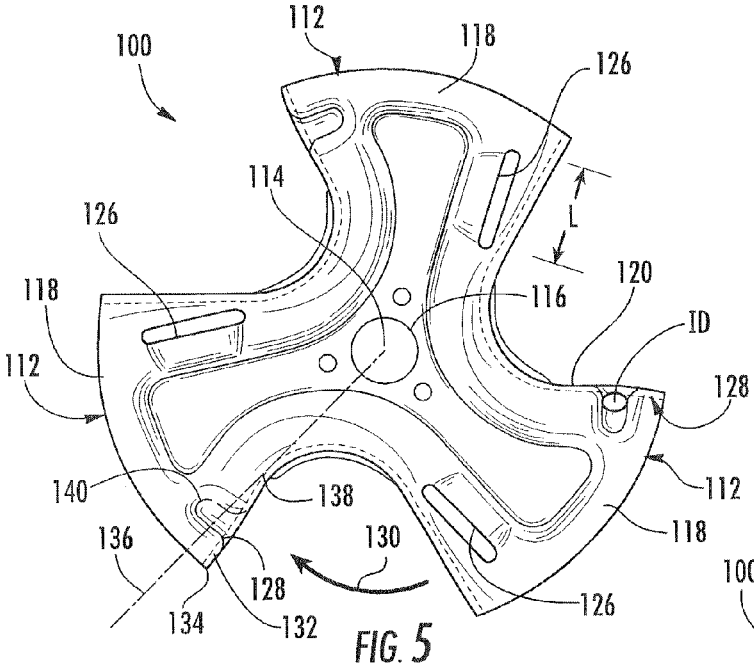
FIG. 5 is a bottom plan view of the impeller of FIG. 4.

FIG. 5 is a top view of impeller 100 illustrating the snow driving face 128 of each blade 120. As indicated by arrow 130 in FIG. 5, impeller 100 is configured to be driven in a clockwise direction (a "forward direction") about axis 114 by engine 28 (shown in FIG. 1). Each snow driving face 128 extends behind its associated or corresponding blade supporting wall 118. Said another way, the blade support wall 118 of each shovel 112 extends along the base of snow driving face 128 and projects forward in the rotational direction of impeller 100. As a result, blade support wall 118 assists in carrying and supporting snow being driven by snow driving face 128 prior to throwing of the snow through discharge chute 38 (shown a FIG. 1).

As further shown by FIG. 5, the snow driving face 128 of each blade 120 includes a recessed portion 132 proximate an outermost radial tip 134 that faces and is recessed from a plane 136 containing rotational axis 114 and extending from rotational axis 114 tangent to the snow driving face 128 of the blade 120. For purposes of this disclosure, the term "tangent" means to touch a curve or surface at a point so that it is closer to the curve in the vicinity of the point than any other line or plane drawn through the point. Because snow driving face 128 includes recessed portion 132, snow driving face 128 more effectively throws snow through discharge chute 38.

In the example embodiment illustrated, recessed portion 132 of snow driving face 128 is concave. In one embodiment, recessed portion 132 has a radius of curvature of between 16 inches and 22 inches. In the example illustrated, snow driving face 128 additionally includes a convex portion 138 facing the plane between recessed portion 132 and the rotational axis 114 of impeller 100. The convex portion 138 further enhances the snow throwing efficiency of snow driving face 128 of blade 120.

In other embodiments, snow driving face 128 may have other configurations. For example, in other embodiments, recessed portion 132 of snow driving face 128 may not be concave, but may instead be planar or flat or may be convex. In some embodiments, convex portion 138 may be omitted. In yet other embodiments, recessed portion 132 may be omitted, wherein snow driving face 128 extends within plane 136 or forward of plane 136.

Figure 6:
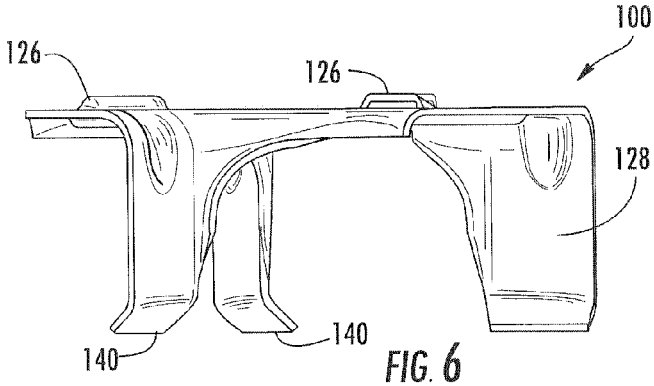
FIG. 6 is a first side elevational view of the impeller of FIG. 4.
Figure 7:
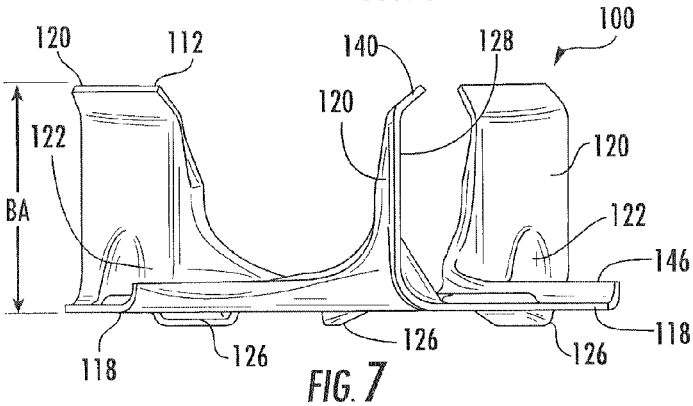
FIG. 7 is a second side elevational view of the impeller of FIG. 4.

As shown by FIGS. 6 and 7, each blade 120 additionally includes an angled top or tip portion 140. Each tip portion 140 extends oblique from snow driving face 128 in the forward direction from snow driving face 128. Tip portion 140 cooperate with snow driving face 128 of blade 120 and blade supporting wall 118 to contact snow on three sides to facilitate scooping and caring of snow to discharge chute 38 (shown in FIG. 1). In other embodiments, tip portion 140 may be omitted.

Figure 8:
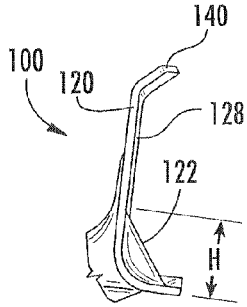
FIG. 8 is a sectional view of the impeller of FIG. 4.

As shown by FIGS. 6 and 8, depression gussets 122 comprise indentations formed in the layer, wherein the indentations are angled so as to extend between and unite blade supporting wall 118 and blade 120. Depression gussets 122 serve as trusses for reinforcing and rigidifying blade 120. Because depression gussets 12 are formed by deforming the layer of material, rather than welding or otherwise connecting additional structures, manufacturing cost and complexity of impeller 100 may be reduced.

As shown by FIG. 8, each gusset 138 has a height, H, measured perpendicular from blade supporting wall 118, of between 1.5 inches and 1.9 inches. As shown in FIG. 5, each gusset 138 has an inside diameter ID of between 0.4 inches and 0.8 inches. As a result, the depression gussets 122 provide blade 120, formed from low carbon nine gauge steel, with sufficient strength to engage, contact and throw snow. In other embodiments, depression gussets 122 may have other configurations or may be omitted.

As best shown by FIG. 4, web 124 comprises an edge portion extending along a leading edge of each blade supporting wall 118 and to the next successive blade 120 of the next successive shovel 112. Web 124 has a concave side 146 facing away from rotational axis 114 of impeller 100. Web 124 rigidifies and strengthens blade supporting wall 118 as well as the next successive blade 120 of the next successive shovel 112. In other embodiments, web 124 may be omitted or may have other configurations.

Figure 9:
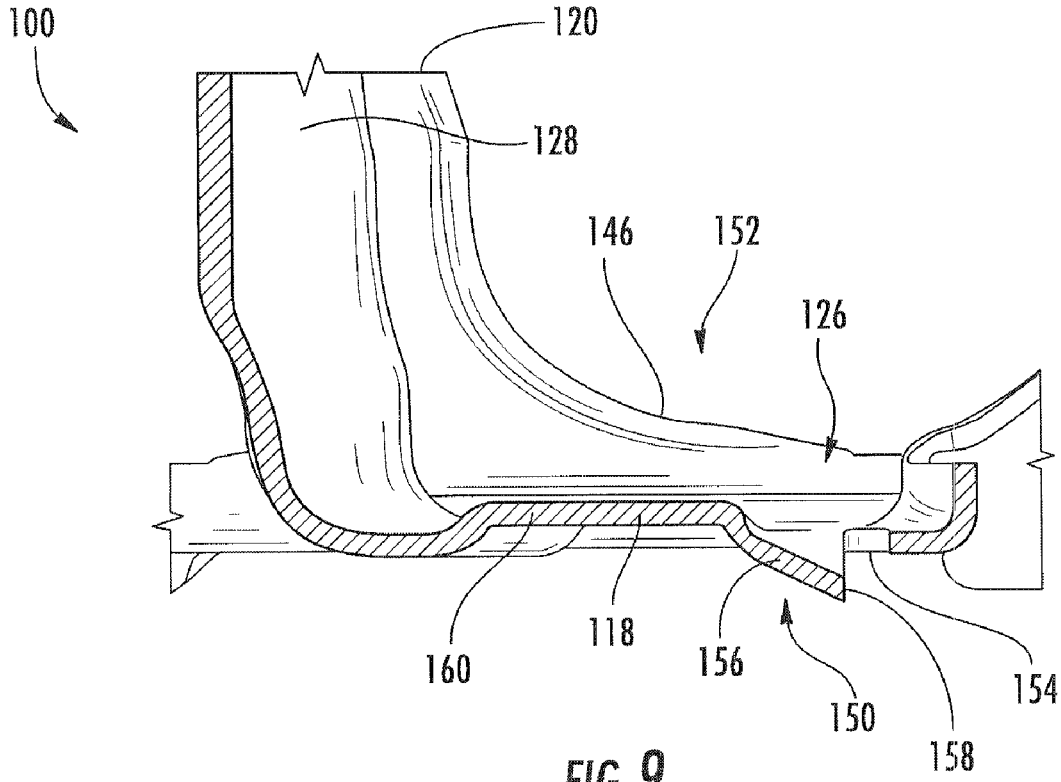
FIG. 9 is a sectional view of the impeller of FIG. 4.

Louvers 126 are formed in blade supporting walls 118 of shovels 112. Louvers 126 assist in removing snow and ice from a backside 150 of blade supporting walls 118 and directing such removed the snow and ice to an opposite front side 152 of blade supporting walls 118. FIG. 9 is a sectional view of impeller 100 illustrating one of louvers 126 in more detail. As shown by FIG. 9, each louver 126 comprises an opening 154 through blade supporting wall 118 between sides 150 and 152. Each opening 154 is partially framed by a slanted fin or slat 156 having a scraping edge 158 projecting away from impeller 100 on side 150. As shown by FIG. 4, scraping edge 158 of each louver 126 faces in the forward direction, i.e., the direction in which impeller 100 is rotated by engine 28 about axis 114.

During rotation of impeller 100, snow and ice may sometimes collect under or behind blade supporting portion 118 between blade supporting portion 118 and an axial end of impeller housing 36. The snow and ice buildup may damage impeller 100 or impeller housing 136. The rotational impeller 100, edge 158 scrapes or removes such built-up snow and ice, whereby the snow and ice passes through opening 154 to the front side 152 of impeller 100. Continued rotation of impeller 100 causes snow driving face 128 of blade 120 to contact and throw the snow through discharge chute 38 (shown in FIG. 1). As a result, the likelihood of snow and ice buildup and the likelihood of damage resulting from such build-up is reduced. Because louvers 126 are formed by stamping and deforming portions of a single layer of material forming impeller 100, no additional steps or additional parts are utilized in providing louvers 126.

According to one example embodiment, each scraping edge 158 has a length L (shown in FIG. 5) of at least 1 inch and nominally between 1.1 inches and 1.5 inches. As a result, each scraping edge 158 sufficiently removes accumulated snow and ice. In other embodiments, louvers 126 may have other configurations or may be omitted. In the example embodiment illustrated, impeller 100 is specifically configured to be stamped and formed from a single sheet of material. As shown by FIG. 7, impeller 100 includes three shovels spaced approximately 120 degrees apart from one another with no intervening shovels 112 therebetween and with no intervening blades therebetween. Because impeller 100 includes only three shovels 112 and only three blades 120, each shovel 112 may be formed solely from a single stamped and deformed sheet (without any additional parts or components) and may be provided with a blade height, BH, measured perpendicularly from blade supporting wall 118, of at least 4 inches and nominally between 4.45 inches and 5.5 inches. In other words, because impeller 120 consists of central portion 110 and three shovels 112, each shovel 112 may be formed from a stamped sheet and may have a larger scooping volume, defined by the surface areas of blade supporting wall 118 and blade 120, allowing shovels 112 to more efficiently discharge snow.

In the example illustrated, impeller 100 is specifically configured for self alignment with shaft coupler 102. As shown by FIG. 3, impeller 100 includes a non-circular depression 160 about aperture 116 (shown in FIG. 4). Depression 160 extends into central portion 110. In the example illustrated, depression 160 further radially extends outward from central portion 110 along each of blade supporting walls 118 of shovels 112. As a result, depression 160 serves dual functions of self aligning with shaft coupler 102 and strengthening blade supporting walls 118 of shovels 112. In the example illustrated, depression 160 includes three legs angularly spaced 120 degrees apart from one another and centrally extending along each shovel 112. In other embodiments, depression 160 may have other configurations or may be omitted.

Shaft coupler 102 comprises a mechanism configured to connect impeller 100 to a shaft of transmission 31. In the example illustrated, shaft coupler 102 is configured to be connected to impeller 100 without welding, facilitating easier manufacture of impeller assembly 40. Shaft coupler 102 includes hub 164 and key portions 166. Hub 164 is configured to be inserted through aperture 161 and includes a central bore 170 configured to receive the shaft (not shown) of transmission 31. In one embodiment, the shaft may be secured to hub 164 with a set screw 171 (shown in FIG. 3). In other embodiments, the shaft may be secured to hub 164 in other fashions.

Key portions 166 comprise extensions extending from hub 164 which are sized and located so as to be mated or keyed into the noncircular depression 160. In the example illustrated, depression 160 includes three fingers or extensions equiangularly spaced about axis 114 (spaced 120 degrees in the embodiment shown), whereas coupler 102 includes a corresponding three projections or fingers which are received within depression 160. As a result, coupler 102 provides an intracal key such that impeller 100 is rotated with the rotation of the shaft connected to hub 164. In other embodiments, shaft coupler 102 may have other configurations or may be omitted where other mechanisms are used for joining transmission 31 to impeller 100.

As shown by FIG. 3, each of key portions 166 additionally includes a bore 172 through which a fastener may extend into central portion 110 to further secure shaft coupler 102 to impeller 100. In one embodiment, central portion 110 includes corresponding bores 174 (shown in FIG. 4) through which fasteners may extend. In one embodiment, one or both of bores 172, 174 may be internally threaded. In other embodiments, such fasters may comprise bolts and corresponding nuts. In still other embodiments, other mechanisms may be used to retain coupler 102 to impeller 100.

Figure 10:
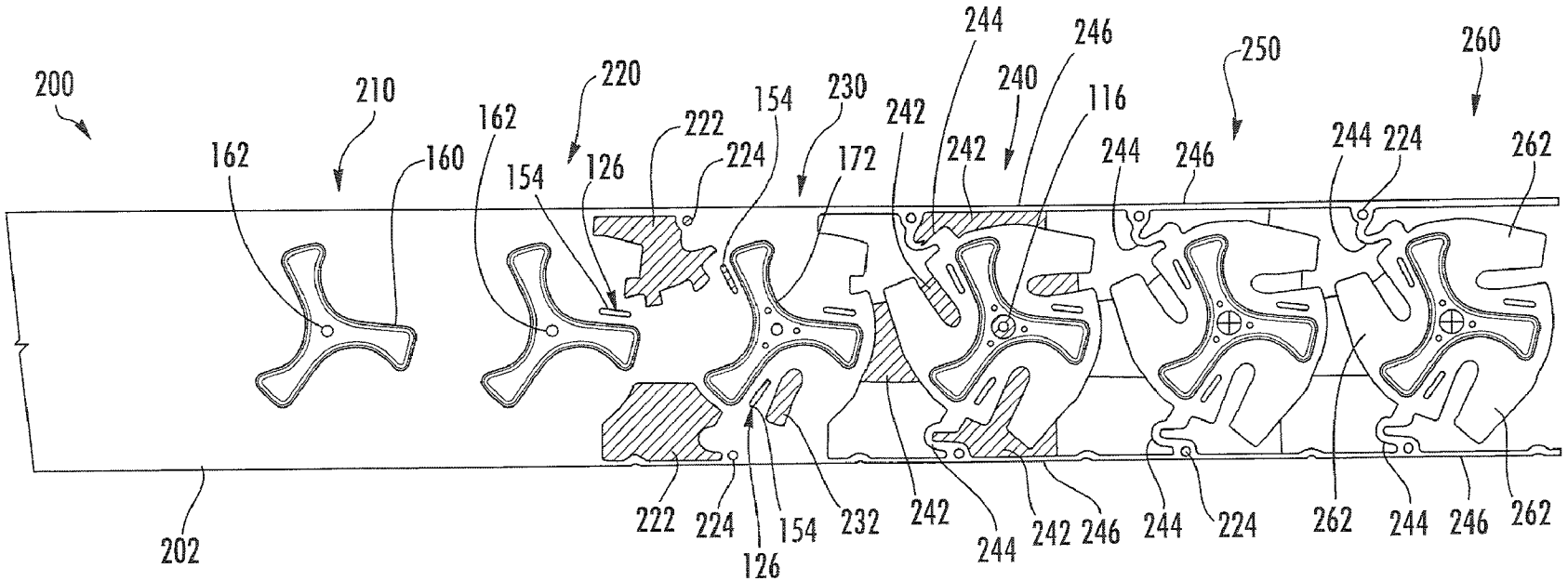
FIG. 10 is a top plan view of a strip layout for forming the impeller of FIG. 4.

FIG. 10 is a strip layout 200 illustrating one example method for forming impeller 40 as shown in FIG. 4. From left to right, strip layout 200 illustrates various stamping, embossing and forming steps or stages for transforming a layer or sheet of material into a three-dimensional impeller such as impeller 40. As noted above, in one embodiment, impeller 40 is formed from a coil, sheet or strip 202 of 9 gauge low carbon steel. In other embodiments, other materials or thicknesses may be employed for forming impeller 40.

In the example illustrated, in a first step or stage 210, an embossing device or tool deforms strip 202 to form depression 160. A stamping tool also works upon strip 202 to form an initial pilot hole 162 that is used for alignment of subsequent tooling with strip 202.

In stage 220, a stamping tool or die engages strip 202 to form the opening 154 and slat 156 (shown in FIG. 9) of a louver 126. In addition, tooling further engages strip 202 to cut out portions 222 and pilot holes 224. In step or stage 230, the tooling forms openings 154 and slats 156 of the other louvers 126 and further forms bores 172. The tooling also cuts out or removes portion 232.

In stage 240, tooling works upon strip 202 to cut out or form aperture 116. The tooling further removes portions 242 to form expansion webs 244 extending from carrier 246. In stage or step 250, tooling works upon strip 202 to provide each blade 120 (shown in FIG. 4) with its cup shape and to further bend tip portions 140. Lastly, in step 260, the tooling works upon strip 202 to deform and bend portions 262 to form blades 120, providing blades 120 with their generally perpendicular orientation with respect to supporting wall 118 as shown in FIG. 4. After impeller 40 is substantially completed, the individual impeller part is separated from carrier 246 by severing the impeller part from expansion web 244. As shown in FIG. 10, impeller 40 is formed without welding or other complex or time-consuming fabrication processes.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A snow thrower comprising:

an engine;

an auger housing configured to receive a snow;

an auger within the auger housing and operably coupled to the engine so as to be driven by the engine;

an impeller housing configured to receive snow driven by the auger from the auger housing;

a discharge chute extending from the impeller housing; and an impeller within the impeller housing and operably coupled to the engine so as to be driven by the engine to discharge snow from the impeller housing through the discharge chute, the impeller comprising:

a layer of material comprising:

a blade support wall; and three blades extending from the blade support wall and spaced 120 degrees about a rotational axis of the impeller with no other blades between the three blades, each of the three blades having a height measured perpendicularly from the blade support wall of at least 4 inches, wherein each of the three blades has a recessed portion proximate an outermost tip of the blade, the recessed portion facing and recessed from a plane that contains the rotational axis of the impeller and that extends from the rotational axis tangent to the snow driving face.

2. The snow thrower of claim 1, wherein the recessed portion is concave.

3. The snow thrower of claim 1, wherein the recessed portion has a radius of curvature of between 16 inches and 22 inches.

4. The snow thrower of claim 1, wherein the snow driving face includes a convex portion between the recessed portion and the rotational axis of the impeller.

5. The snow thrower of claim 1, wherein each of the three blades has a snow driving face, the snow driving face of each blade facing in a direction about the rotation axis of the impeller and wherein the impeller further comprises louvers extending through the blade support wall, each louver facing in the direction.

6. The snow thrower of claim 5, wherein each of the three blades project from a first side of the blade support wall and wherein the louvers have fins projecting from a second side of the blade support wall opposite the first side.

7. The snow thrower of claim 1, wherein each of the three blades has a snow driving face, the snow thrower further comprising a depression gusset in the snow driving face of each blade and extending from the blade to the blade support wall, each depression gusset having a maximum inside diameter of between 0.4 inches and 0.8 inches and a height measured perpendicularly from the blade support wall of between 1.5 inches and 1.9 inches.

8. The snow thrower of claim 1, wherein the impeller further comprises:

an aperture through the layer; and a non-circular depression in the layer about the aperture;

wherein the snow thrower further comprises a shaft coupler comprising:

a hub received within the aperture and configured to mount to a shaft; and key portions extending from the hub and received within the non-circular depression so as to key the hub to the impeller.

9. The snow thrower of claim 8 further comprising fasteners extending through the layer into the key portions.

10. The snow thrower of claim 1, wherein each of the three blades has a snow driving face and wherein the snow thrower further comprises a web extending and tapering from the snow driving face of each blade on a same side of the impeller as the snow driving face to a perimeter of the blade support wall.

11. The snow thrower of claim 10, wherein the web has a concave side facing away from the rotational axis of the impeller.

12. The snow thrower of claim 1, wherein each of the three blades has a snow driving face and wherein each blade has a top portion extending oblique from the snow driving face.

13. The snow thrower of claim 1, wherein each of the three blades include a snow driving face facing in a direction and wherein the blade support wall extends along a base of the snow driving face and projects in the direction from the snow driving face.

14. A snow thrower impeller comprising:

a layer of material comprising:

a central portion about a rotational axis of the impeller; and a plurality of shovels extending from the central portion, each shovel comprising:

a blade having a snow driving face facing in a direction; and a blade support wall extending along a base of the snow driving face and projecting in the direction from the snow driving face, wherein the blade of each shovel has a recessed portion proximate an outermost tip of the blade, the recessed portion facing and recessed from a plane that contains the rotational axis of the impeller and that extends from the rotational axis tangent to the snow driving face.

15. The snow thrower impeller of claim 14, wherein the snow driving face of each blade face in a first direction about the rotation axis of the impeller and wherein the impeller further comprises louvers extending through the blade support wall, each louver facing in the first direction.

16. The snow thrower impeller of claim 14, further comprising a depression gusset in the snow driving face of each blade and extending from the blade to the blade support wall, each depression gusset having a maximum inside diameter of between 0.4 inches and 0.8 inches and a height measured perpendicularly from the blade support wall of between 1.5 inches and 1.9 inches.

17. The snow thrower impeller of claim 14, wherein the impeller further comprises:

an aperture through the layer;

a non-circular depression in the layer about the aperture; and a shaft coupler comprising:

a hub received within the aperture and configured to mount to a shaft; and key portions extending from the hub and received within the non-circular depression so as to key the hub to the impeller.

18. The snow thrower impeller of claim 14 further comprising a web extending and tapering from the snow driving face of each blade on a same side of the impeller as the snow driving face to a perimeter of the blade support wall.

19. A snow thrower impeller comprising:

a layer of material comprising:

a blade support wall; and three blades extending from the blade support wall and spaced 120 degrees about a rotational axis of the impeller with no other blades between the three blades, each of the three blades having a height measured perpendicularly from the blade support wall of at least 4 inches and a snow driving face having a recessed portion proximate an outermost tip of the blade, the recessed portion facing and recessed from a plane that contains the rotational axis of the impeller and that extends from the rotational axis tangent to the snow driving face.

20. A method for making a snow thrower impeller, the method comprising:

stamping a sheet of material;

deforming of the sheet to form a plurality of shovels extending from the central portion, each shovel comprising:

a blade having a snow driving face facing in a direction; and a blade support wall extending along a base of the snow driving face and projecting in the direction from the snow driving face, wherein the blade of each shovel has a recessed portion proximate an outermost tip of the blade, the recessed portion facing and recessed from a plane that contains the rotational axis of the impeller and that extends from the rotational axis tangent to the snow driving face.

21. The method of claim 20 further comprising forming louvers extending through the blade support wall.

22. A snow thrower comprising:

an engine;

an auger housing configured to receive a snow;

an auger within the auger housing and operably coupled to the engine so as to be driven by the engine;

an impeller housing configured to receive snow driven by the auger from the auger housing;

a discharge chute extending from the impeller housing;

an impeller within the impeller housing and operably coupled to the engine so as to be driven by the engine to discharge snow from the impeller housing through the discharge chute, the impeller comprising:

a layer of material comprising:

a blade support wall; and three blades extending from the blade support wall and spaced 120 degrees about a rotational axis of the impeller with no other blades between the three blades, each of the three blades having a height measured perpendicularly from the blade support wall of at least 4 inches;

an aperture through the layer; and a non-circular depression in the layer about the aperture; and a shaft coupler comprising:

a hub received within the aperture and configured to mount to a shaft; and key portions extending from the hub and received within the non-circular depression so as to key the hub to the impeller.

23. The snow thrower of claim 22 further comprising fasteners extending through the layer into the key portions.

24. A snow thrower impeller comprising:

a layer of material comprising:

a central portion about a rotational axis of the impeller;

a plurality of shovels extending from the central portion, each shovel comprising:

a blade having a snow driving face facing in a direction; and a blade support wall extending along a base of the snow driving face and projecting in the direction from the snow driving face;

an aperture through the layer;

a non-circular depression in the layer about the aperture; and a shaft coupler comprising:

a hub received within the aperture and configured to mount to a shaft; and key portions extending from the hub and received within the non-circular depression so as to key the hub to the impeller.

25. A snow thrower comprising:

an engine;

an auger housing configured to receive a snow;

an auger within the auger housing and operably coupled to the engine so as to be driven by the engine;

an impeller housing configured to receive snow driven by the auger from the auger housing;

a discharge chute extending from the impeller housing; and an impeller within the impeller housing and operably coupled to the engine so as to be driven by the engine to discharge snow from the impeller housing through the discharge chute, the impeller comprising:

a layer of material comprising:

a blade support wall; and three blades extending from the blade support wall and spaced 120 degrees about a rotational axis of the impeller with no other blades between the three blades, each of the three blades having a height measured perpendicularly from the blade support wall of at least 4 inches, wherein each of the three blades has a snow driving face;

a web extending and tapering from the snow driving face of each blade on a same side of the impeller as the snow driving face to a perimeter of the blade support wall.

26. A snow thrower impeller comprising:

a layer of material comprising:

a central portion about a rotational axis of the impeller; and a plurality of shovels extending from the central portion, each shovel comprising:

a blade having a snow driving face facing in a direction;

a blade support wall extending along a base of the snow driving face and projecting in the direction from the snow driving face; and a web extending and tapering from the snow driving face of each blade on a same side of the impeller as the snow driving face to a perimeter of the blade support wall.

* * * * *